US006589049B1

(12) United States Patent
Sutton et al.

(10) Patent No.: US 6,589,049 B1
(45) Date of Patent: Jul. 8, 2003

(54) ROTARY KILN SEAL

(75) Inventors: Shawn Robert Sutton, Claysville, PA (US); Kinsley Madison Desch, Washington, PA (US)

(73) Assignee: IGS, Inc., Meadow Lands, PA (US)

( * ) Notice: Subject to any disclaimer, the term of this patent is extended or adjusted under 35 U.S.C. 154(b) by 0 days.

(21) Appl. No.: 10/139,937

(22) Filed: May 3, 2002

(51) Int. Cl.[7] ..... F27B 7/24

(52) U.S. Cl. ..... 432/115; 277/358; 277/390; 277/391

(58) Field of Search ..... 432/115; 277/358, 277/390, 391, 590

(56) References Cited

U.S. PATENT DOCUMENTS

| | | | | | |
|---|---|---|---|---|---|
| 4,405,137 | A | * | 9/1983 | Webb | 277/553 |
| 4,961,588 | A | * | 10/1990 | Brienza | 277/545 |
| 5,571,269 | A | | 11/1996 | Buelow | |
| 5,704,301 | A | * | 1/1998 | Blasiole | 110/246 |
| 6,464,493 | B2 | * | 10/2002 | Polino et al. | 432/115 |

* cited by examiner

*Primary Examiner*—Gregory A. Wilson
(74) *Attorney, Agent, or Firm*—Ansel M. Schwartz

(57) ABSTRACT

A rotary seal assembly for a rotary kiln having a hood and a rotary drum with an opening formed between the drum and the hood, and an end. The rotary seal assembly includes a flexible framework arrangement that attaches to the end. The rotary seal assembly includes a riding surface that engages the drum as the drum rotates and connects with the framework arrangement in response to the movement of the drum as the drum rotates end. The rotary seal assembly includes a seal that is supported by the riding surface and is in essentially 360 degree contact with the drum when it is rotating and seals the opening between the drum when it is rotating in the hood to prevent fluid flow into and out of the end. A method for sealing an opening formed between a drum and a hood. The method includes the steps of attaching a flexible framework arrangement to the hood. There is the step of connecting a riding surface with the framework arrangement so the riding surface engages the drum as the drum rotates in response to the movement of the drum as the drum rotates. There is the step of sealing the opening between the drum when it is rotating in the hood to prevent fluid flow into and out of the end with a seal that is supported by the riding surface and is in essentially 360 degree contact with the drum when it is rotating.

16 Claims, 6 Drawing Sheets

ROTARY KILN SEAL

FIELD OF THE INVENTION

The present invention relates to the air or gas sealing arrangements for rotary drums such as high temperature rotary kilns, or more specifically, a flexible seal for sealing the opening between a rotating drum and a stationary hood to prevent the flow of gaseous fluids into and out from the ends of the rotary drum.

BACKGROUND OF THE INVENTION

It is a common practice to employ a flexible seal at the ends of a rotary kiln to seal the annular space between the rotating drum of the kiln and the stationary housing at each end of the kiln. It is desirable to seal these open spaces due to the high temperatures, often exceeding 2500F. in cement applications, found within the kilns. Sealing these spaces provides substantial benefits by confining toxic gases within the kiln and increasing energy efficiency through prevention of loss of the heated gas.

Overlapping leaf type seals such as U.S. Pat. Nos. 4,405,137 and 5,571,269 incorporate metal leaves that flex with the eccentric motion of the rotating drum. Such movement opens up small gaps in between the leaves themselves and in between the leaves and rotating drum. Such openness causes a drop in efficiency of the sealing arrangement.

The present invention incorporates a framework of pivoting arms and a metallic or non-metallic riding surface that supports a fabric seal such that there is 360 degree contact between the seal and rotating drum surface. The fabric is continuous about the rotating drum and has only 1 overlap that does not open up. The metallic or non-metallic riding segments are overlapping; however no gaps open up since they lay flat and slide on the rotating drum parallel to the direction of rotation.

SUMMARY OF THE INVENTION

The present invention pertains to a rotary seal assembly for a rotary kiln having a hood and a rotary drum with an opening formed between the drum and the hood, and an end. The rotary seal assembly comprises a flexible framework arrangement that attaches to the end. The rotary seal assembly comprises a riding surface that engages the drum as the drum rotates and connects with the framework arrangement in response to the movement of the drum as the drum rotates end. The rotary seal assembly comprises a seal that is supported by the riding surface and is in essentially 360 degree contact with the drum when it is rotating and seals the opening between the drum when it is rotating in the hood to prevent fluid flow into and out of the end.

The present invention pertains to a method for sealing an opening formed between a drum and a hood. The method comprises the steps of attaching a flexible framework arrangement to the hood. There is the step of connecting a riding surface with the framework arrangement so the riding surface engages the drum as the drum rotates in response to the movement of the drum as the drum rotates. There is the step of sealing the opening between the drum when it is rotating in the hood to prevent fluid flow into and out of the end with a seal that is supported by the riding surface and is in essentially 360 degree contact with the drum when it is rotating.

An improved rotary seal assembly for kiln drums and the like utilizes a series of overlapping metal segments mounted to a hood surrounding the drum. The metal segments are connected to the hood via pivoting arms such that there are movable joints at the hood mounting surface and the sealing segments. Pivot arms are affixed to the hood via a mounting ring and intermediate clamping ring. Fabric covers the permeable metal skeleton and is affixed to the hood end via the fixed intermediate and end clamping rings and affixed to the sealing end via a tension device comprised of fabric tape, metal buckles, and metal tension springs. A braided rope packing seals off the open gap between the intermediate clamping ring and the mounting ring.

BRIEF DESCRIPTION OF THE DRAWINGS

In the accompanying drawings, the preferred embodiment of the invention and preferred methods of practicing the invention are illustrated in which.

DETAILED DESCRIPTION

Figure 1:
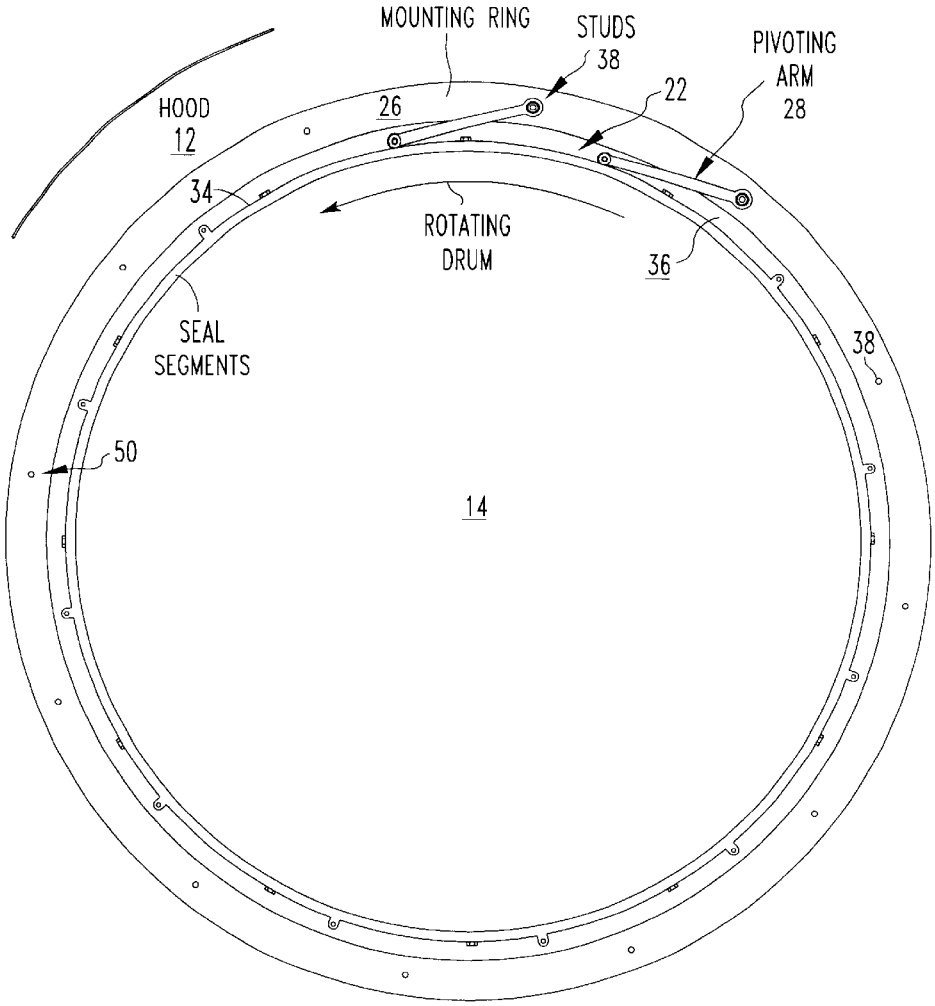
FIG. 1 is a schematic representation of a side view of the assembly of the present invention with the hood and rotating drum.
Figure 2:
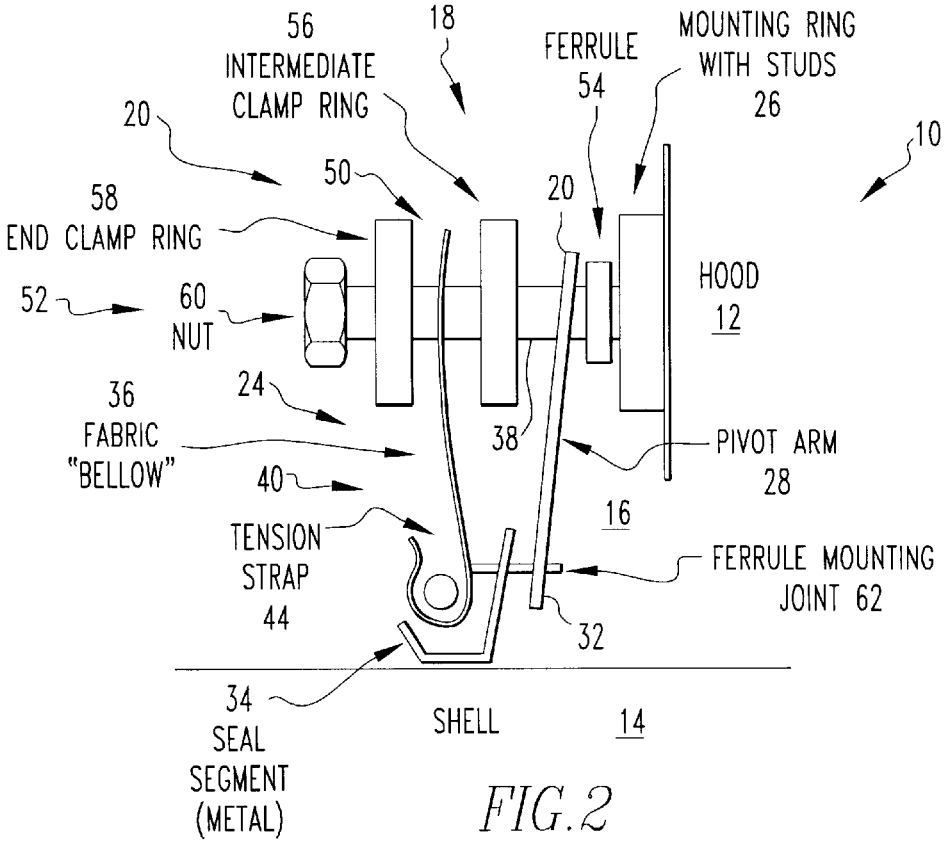
FIG. 2 is a schematic representation of a cross-sectional view of the assembly.

Referring now to the drawings wherein like reference numerals refer to similar or identical parts throughout the several views, and more specifically to FIGS. 1, 2 and 6–8 thereof, there is shown a rotary seal assembly 10 for a rotary kiln having a hood 12 and a rotary drum 14 with an opening 16 formed between the drum 14 and the hood 12, and an end 18. The rotary seal assembly 10 comprises a flexible framework arrangement 20 that attaches to the end 18. The rotary seal assembly 10 comprises a riding surface 22 that engages the drum 14 as the drum 14 rotates and connects with the framework arrangement 20 in response to the movement of the drum 14 as the drum 14 rotates end 18. The rotary seal assembly 10 comprises a seal 24 that is supported by the riding surface 22 and is in essentially 360 degree contact with the drum 14 when it is rotating and seals the opening 16 between the drum 14 when it is rotating in the hood 12 to prevent fluid flow into and out of the end 18.

Figure 3:
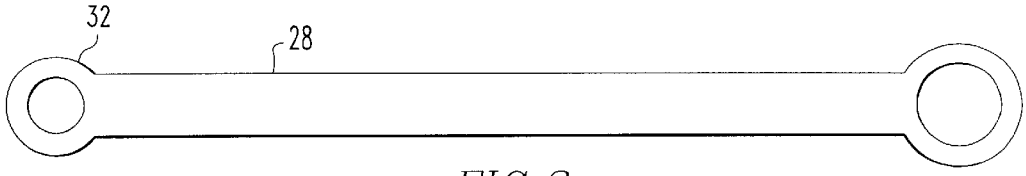
FIG. 3 is a schematic representation of a pivot arm.
Figure 4:
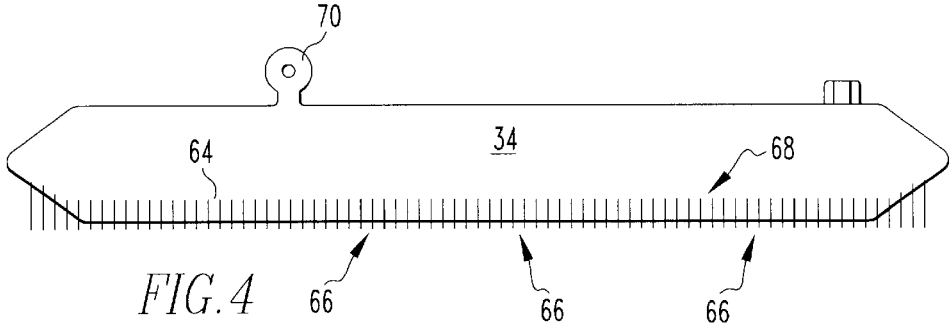
FIG. 4 is a schematic representation of a seal segment.

Preferably, the arrangement 20 includes a mounting ring 26 that fixes to the hood 12. The arrangement 20 preferably includes pivot arms 28 having a first end 30 and a second end 32 that are connected at their first end 30 to the mounting ring 26 and at their second end 32 to the riding surface 22. FIG. 3 shows a pivot arm. Preferably, the riding surface 22 includes a series of seal segments 34 with each seal segment of the series of seal segments 34 connected to the second end 32 of an associated pivot arm of the pivot arms 28. FIG. 4 shows a seal segment.

The seal 24 preferably includes a fabric seal 36 in contact with the mounting ring 26 and the series of seal segments 34 about the drum 14. Preferably, the mounting ring 26 includes studs 38 disposed about the drum 14 with the first end 30 of a pivot arm sliding onto a respective associated stud of the studs 38. The seal 24 preferably includes a tensioning assembly 40 which holds the fabric seal 36 under tension against the series of seal segments 34, and the fabric seal 36 and the series of seal segments 34 under tension against the drum 14. Preferably, the fabric seal 36 includes belt loops 42 and the tension ring assembly includes a tension strap 44 which is laced through the belt loops 42, metal adjustment buckles 46 attached to the ends of the strap, and metal tension springs 48 attached to the buckles 46.

Figure 5:
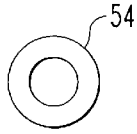
FIG. 5 is a schematic representation of a ferrule.
Figure 6:
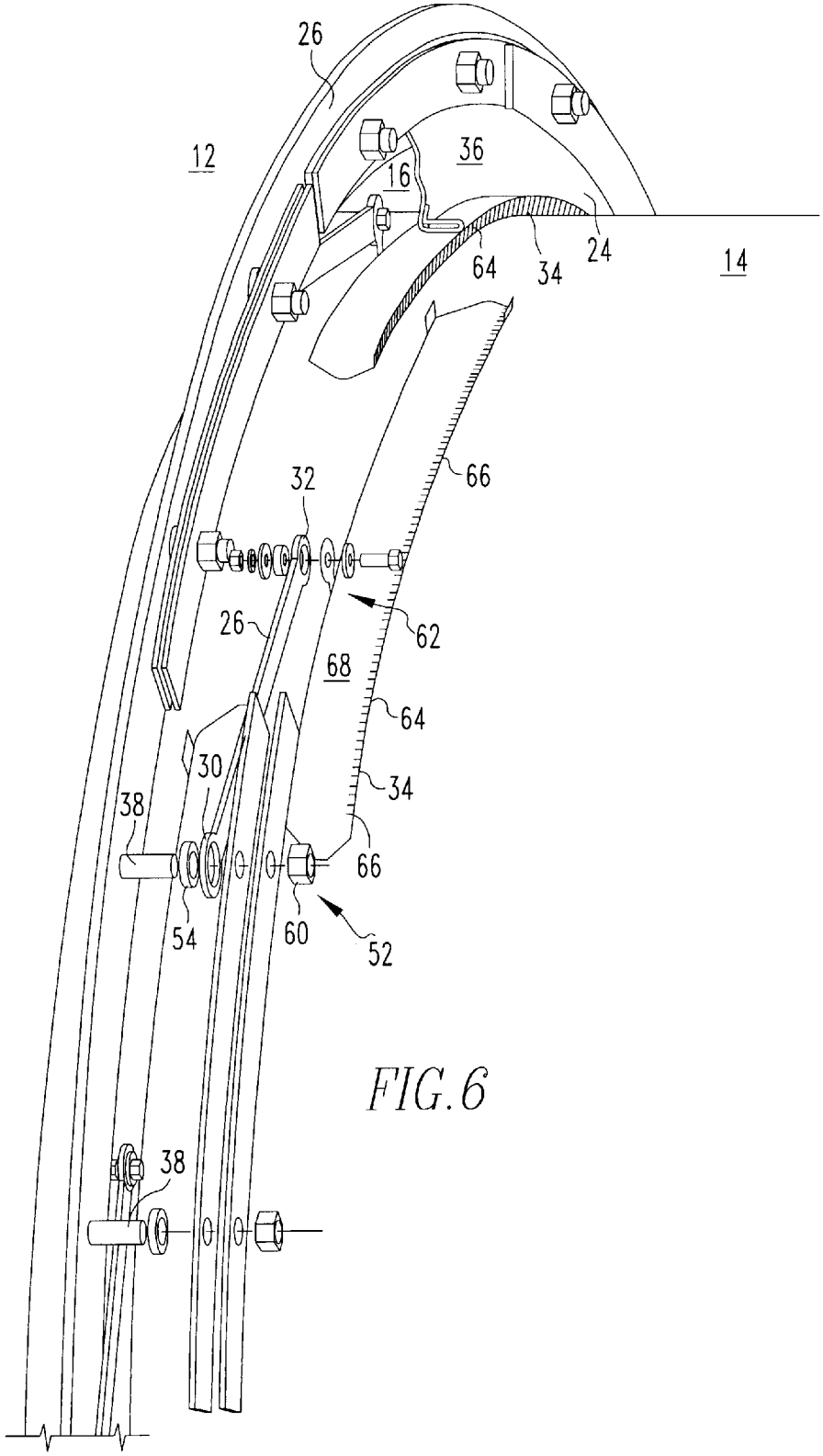
FIG. 6 is a schematic representation of a perspective view of the assembly.
Figure 7:
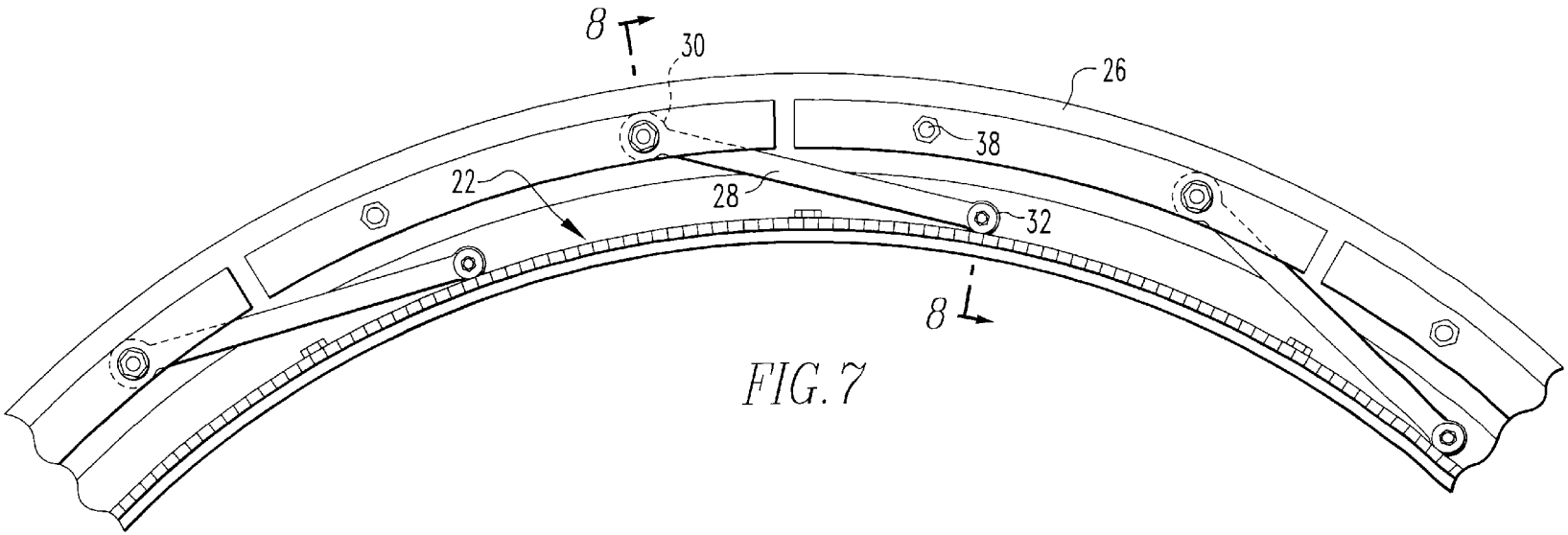
FIG. 7 is a schematic representation of an elevational view of the assembly.
Figure 8:
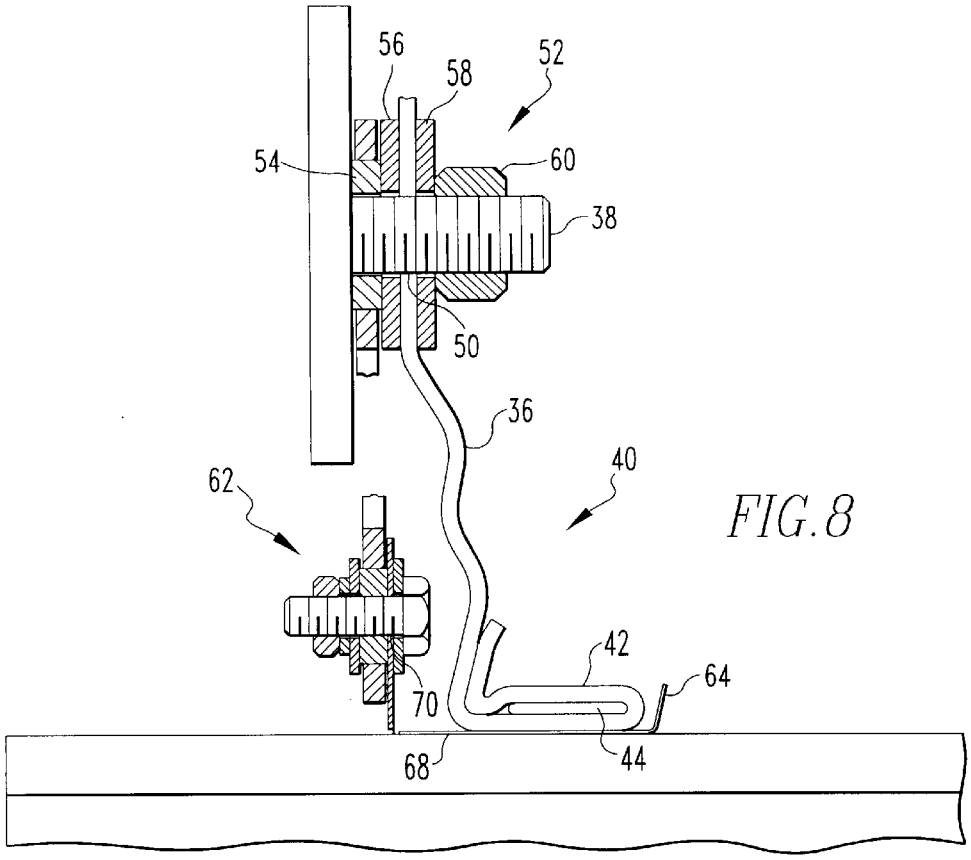
FIG. 8 is a schematic representation of a sectional view of FIG. 7.
Figure 9:
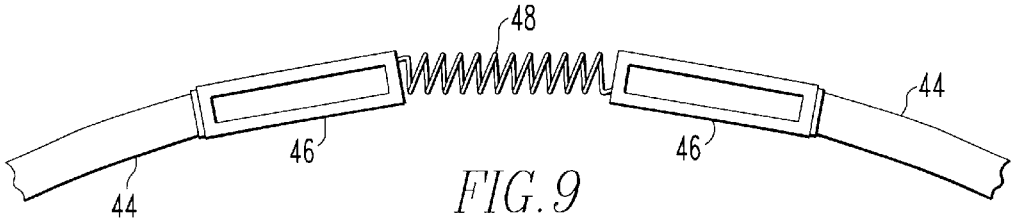
FIG. 9 is a schematic representation of a tensioning assembly.

The fabric seal 36 has bolt holes 50 arranged to align with the studs 38 of the mounting ring 26 so each bolt hole of the bolt holes 50 slides on a respective associated stud. Preferably, the arrangement 20 includes a locking assembly 52 at each stud to hold the seal fabric and the pivot arm to the mounting ring 26. The locking assembly 52 preferably includes a ring ferrule 54. disposed on the stud between the mounting ring 26 and the pivot arm, an intermediate clamp ring 56 disposed on the stud between the pivot arm and the fabric seal 36, an end clamp ring 58 disposed on the stud over the fabric seal 36, and a nut 60 disposed on the stud over the end clamp ring 58. FIG. 5 shows a ferrule. Preferably, the riding surface 22 includes a ferrule mounted joint 62 associated with each seal segment which movably holds the pivot arm to the seal segment.

The present invention pertains to a method for sealing an opening 16 formed between a drum 14 and a hood 12. The method comprises the steps of attaching a flexible framework arrangement 20 to the hood 12. There is the step of connecting a riding surface 22 with the framework arrangement 20 so the riding surface 22 engages the drum 14 as the drum 14 rotates in response to the movement of the drum 14 as the drum 14 rotates. There is the step of sealing the opening 16 between the drum 14 when it is rotating in the hood 12 to prevent fluid flow into and out of the end 18 with a seal 24 that is supported by the riding surface 22 and is in essentially 360 degree contact with the drum 14 when it is rotating.

Preferably, there is the step of fixing a mounting ring 26 of the arrangement 20 to the hood 12. There is preferably the step of connecting pivot arms 28 of the arrangement 20 at their first end 30 to the mounting ring 26 and at their second end 32 to the riding surface 22. Preferably, there is the step of connecting a series of seal segments 34 of the riding surface 22 to the second end 32 of an associated pivot arm of the pivot arms 28. There is preferably the step of includes studs 38 with sliding the first end 30 of a pivot arm onto a respective associated stud of a plurality of studs 38 of the mounting ring 26 disposed about the drum 14.

Preferably, there is the step of holding the fabric seal 36 under tension against the series of seal segments 34, and the fabric seal 36 and the series of seal segments 34 under tension against the drum 14 with a tensioning assembly 40. There is preferably the step of holding the seal fabric and the pivot arm to the mounting ring 26 with a locking assembly 52 of the arrangement 20. Preferably, there are the steps of disposing a ring ferrule 54 of the locking assembly 52 on the stud between the mounting ring 26 and the pivot arm, disposing an intermediate clamp ring 56 of the locking assembly 52 on the stud between the pivot arm and the fabric seal 36, disposing an end clamp ring 58 of the locking assembly 52 on the stud over the fabric seal 36, and disposing a nut 60 of the locking assembly 52 on the stud over the end clamp ring 58. There is preferably the step of holding the pivot arm to the seal segment with a ferrule mounted joint 62 of the riding surface 22.

In the operation of the invention, and with reference to FIGS. 1, 2 and 6–8, the mounting structure comprises a braided rope packing affixed to the outer edge of the mounting ring 26 with adhesive. This will seal the open gap formed between the mounting ring 26 and the intermediate clamping ring when installed. A metal mounting ring 26 is manufactured such that it affixes (bolts or welds) directly to a hood 12 surrounding a rotating drum 14. The hood 12 face is at a 90 degree angle to the outside surface of the drum 14. The mounting ring 26 has studs 38 welded into it which are perpendicular to the face of the ring. An intermediate clamping ring 56 and an end clamping ring 58 of equal outer and inner diameters is manufactured with bolt holes 50 similar to the mounting ring 26 stud pattern such that the clamping rings slide over the studs 38 and affixes the sealing components in place. The clamping rings are held tight with flat washers, lock washers, and nuts 60. Rings are produced internally whereas nuts 60, studs 38, and washers are bought out items.

In regard to the seal components and metal skeleton support, the skeleton of this seal 24 is comprised of a pivoting arm, attached at one end 18 to the mounting structure. At the other end 18 of the pivot arm is an attached metal segment that rides directly on the drum 14 outer surface or on a wear ring fixed to the drum 14 at an equidistant annular spacing. The second end 32 of the pivot arm connects to the seal segment through a ferrule mounted joint 62 mounted to a doughnut 70 of the seal segment.

The pivot arm attaches to the mounting ring 26 by sliding the arm over the mounting studs 38 and a ferrule that allows for the pivoting action. The intermediate clamping ring slips over the mounting studs 38 and traps the ferrules and the pivot arm in place while allowing movement of the pivot arm. The metal segments are attached to the other end of the pivot arm with a nut 60 and bolt assembly. A ferrule is inserted over a bolt whereas the pivot arm slides over the ferrule thus allowing movement similar to the mounting joint. A flat washer, lock washer, and nut 60 hold the attachment together. This series is repeated several times to produce an overlapping surface of the metal segments riding against the drum 14 or the wear ring. Ferrules, arms, metal segments are manufactured by internal manufacturing processes, whereas nuts 60, bolts, and washers are bought out items.

A fabric cover made of silica Dioxide fabric is sewn into a cover that seals off the annular open gap between the inner diameter of the mounting ring 26 and the drum 14. This fabric cover has relief slits cut into one edge that allows for expansion of the outer diameter of the fabric cover to match the outer diameter of the mounting ring 26. Bolt holes 50 are punched into the fabric to allow for sliding fabric over the studs 38 in the mounting ring 26. The end clamping ring slips over the studs 38 in the mounting ring 26 and traps the fabric in place. Nuts 60, flat washers, and lock washers secure the assembly together. The fabric descends perpendicularly to the metal seal segments 34 and bends 90 degrees at the seal segment top surface, and projects outward to the outside lip 64 of the metal seal segment. Belt loops 42 are sewn into the fabric that allows for a tension strap 44 to be laced through. Metal adjustment buckles 46 are attached to the ends of the tension strap 44. Metal tension springs 48 are attached to the buckles 46 whereas a complete tension assembly is formed. This tension assembly provides tension for the sealing assembly such that it makes 360 degree contact with the drum 14.

As the drum 14 rotates, it displaces radially the seal segments 34 that are held to it by the tensioning belt. The drum 14 slides along the seal segments 34, as the seal segments 34 are essentially held in their angular position as the drum 14 slides along them during its rotation. Each individual seal segment moves radially up or down with the rotating surface of the drum 14 due to the individual seal segment being held in its position by the pivot arm connected to the stud on the mounting ring 26 which is attached to the hood 12. The pivot arm is able to slide relative to the stud on the mounting ring 26 to which it is attached, and the ferrule mounted joint 62 adjacent the seal segment which holds the pivot arm to the seal segment. In this way, the seal segment is able to move with the surface displacement of the drum 14 as the drum 14 rotates by sliding relative to the ferrule mounted joint 62 and to the stud.

The seal fabric extends from the studs 38 on the mounting ring 26 to the seal segment where it is held along the seal contact area 68 of the seal segment by the tension strap 44 that wraps about all the seal segments 34 and the drum 14. There is a lip 64 that is serrated along the seal segment that prevents the tension strap 44 from sliding off the seal segment. The serrations 66 are close together to allow the seal segment to bend but have only a small or minimal gap formed between the serrations 66 as the seal segment bends under the tension of the tension strap 44 and follows the circular shape of the drum 14.

Installation of the rotary seal assembly 10 is as follows:

The mounting/clamping ring is supplied in segments (halves., quarters, etc.) to ease assembly. The mounting ring 26 tack welds directly to the feed/discharge hood 12. Rotate the drum 14 if possible and mark the high and low spot of rotation on the hood 12 face. Use the center of these two lines as the reference for welding. This will ensure that the + and − runout is evenly distributed.

1) Run a belt sander or grinder over the shell surface around the sealing area to remove any rust, weld spatter, beads, or product buildup. If the shell walks longitudinally during operation, sand the area also where the seal 24 will ride.
2) Insert the large ferrules over the mounting studs 38 on the mounting ring 26.
3) Mount the pre-assembled modules, each of which include the seal segment and the pivot arm, such that the slotted lip 64 is facing out from the mounting ring 26. Overlap the segments according to the direction of rotation.
4) Trap the modules in place with the first clamping ring. You can finger tighten the bolts such that the modules align properly.
5) Pre-lace the tension strapping through the belt loops 42 in the fabric.
6) Starting at the top, remove the finger tightened nuts 60 and position the fabric such that it forms a 90-degree angle with the shell and lays flat on top of the metal seal segments 34. At the bottom of the kiln, make sure there is not severe seal sag between the ring and the shell (this will cause the seal 24 to wander and possibly jump the metal segments). The slits should line up with the studs 38 in the ring. Deepen the pre-cut relief slits in the seal 24 to the depth of the bolt circle only. This will "relax" the seal 24 on the mounting ring 26 as well as relieve the "pucker" on the sealing segments. The fabric should have enough clearance as to "bellow" up and down with the shell run-out.
7) Work your way down the sides fairly evenly aligning and deepening slits. As sufficient slits are aligned, clamp the seal 24 in place with the clamping ring segments.
8) When the bottom is reached, make sure the overlap corresponds with the direction of rotation. If installed backwards, the seal 24 will bind up and fail.
9) Lace the tension strap 44 ends into the length adjustment clips.
10) Affix the tension springs 48 to the clips. Do not attach the springs 48 to anything other than the strapping clips and vice versa. Do not hang weights from the springs 48 or strapping. You can adjust the strapping length as needed.
11) Check the sag at the bottom of the seal 24. A slight gap (¼") is desirable at the bottom. This will allow for thermal expansion of the shell when heated.
12) Rotate the shell while pulling operating draft (if possible) to test the seal 24 fit prior to firing and operation. Less draft and burner will be needed as a result of the seal 24. Observe the fit around the sealing surface. Adjust the fit accordingly remembering to allow for thermal shell expansion. The seal 24 only needs to make light continuous contact with the shell to be an effective seal. Cranking it down tight to the shell does not enhance sealing properties. All this will do is cause the seal 24 to wear much faster and possibly buckle and misalign itself.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A rotary seal assembly for a rotary kiln having a hood and a rotary drum with an opening formed between the drum and the hood, and an end comprising:

a flexible framework arrangement that attaches to the hood, the arrangement includes a mounting ring that fixes to the hood;

a riding surface that engages the drum as the drum rotates and connects with the framework arrangement in response to the movement of the drum as the drum rotates, the arrangement includes pivot arms having a first end and a second end that are connected at their first end to the mounting ring and at their second end to the riding surface, the riding surface includes a series of seal segments with each seal segment of the series of seal segments connected to the second end of an associated pivot arm of the pivot arms; and a seal that is supported by the riding surface and is in essentially 360 degree contact with the drum and the hood when the drum is rotating and seals the opening between the drum when it is rotating in the hood to prevent fluid flow into and out of the end.

2. An assembly as described in claim 1 wherein the seal includes a fabric seal in contact with the mounting ring and the series of seal segments about the drum.

3. An assembly as described in claim 2 wherein the mounting ring includes studs disposed about the drum with the first end of a pivot arm sliding onto a respective associated stud of the studs.

4. An assembly as described in claim 3 wherein the seal includes a tensioning assembly which holds the fabric seal under tension against the series of seal segments, and the fabric seal and the series of seal segments under tension against the drum.

5. An assembly as described in claim 4 wherein the fabric seal includes belt loops and the tension ring assembly includes a tension strap which is laced through the belt loops, metal adjustment buckles attached to the ends of the strap, and metal tension springs attached to the buckles.

6. An assembly as described in claim 5 wherein the fabric seal has bolt holes arranged to align with the studs of the mounting ring so each bolt hole of the bolt holes slides on a respective associated stud.

7. An assembly as described in claim 6 wherein the arrangement includes a locking assembly at each stud to hold the seal fabric and the pivot arm to the mounting ring.

8. An assembly as described in claim 7 wherein the locking assembly includes a ring ferrule disposed on the stud between the mounting ring and the pivot arm, an intermediate clamp ring disposed on the stud between the pivot arm and the fabric seal, an end clamp ring disposed on the stud over the fabric seal, and a nut disposed on the stud over the end clamp ring.

9. An assembly as described in claim 8 wherein the riding surface includes a ferrule mounted joint associated with each seal segment which movably holds the pivot arm to the seal segment.

10. A rotary seal assembly for a rotary kiln having a hood and a rotary drum with an opening formed between the drum and the hood, and an end comprising:

a flexible framework arrangement that attaches to the hood, the arrangement includes a mounting ring that fixes to the hood;

a riding surface that engages the drum as the drum rotates and connects with the framework arrangement in response to the movement of the drum as the drum rotates, the arrangement includes pivot arms having a first end and a second end that are only connected at their first end to the mounting ring and only at their second end to the riding surface, the pivot arms extending from the riding surface and the mounting ring out of contact from the riding surface and the mounting ring; and a seal that is supported by the riding surface and is in essentially 360 degree contact with the drum when it is rotating and seals the opening between the drum and the hood when the drum is rotating in the hood to prevent fluid flow into and out of the end.

11. A rotary seal assembly for a rotary kiln having a hood and a rotary drum with an opening formed between the drum and the hood, and an end comprising:

a flexible framework arrangement that attaches to the hood;

a riding surface that engages the drum as the drum rotates and connects with the framework arrangement in response to the movement of the drum as the drum rotates; and a fabric seal that is supported by the riding surface and is in essentially 360 degree contact with the drum when it is rotating and seals the opening between the drum and the hood when the drum is rotating in the hood to prevent fluid flow into and out of the end.

12. An assembly as described in claim 11 wherein the arrangement includes a mounting ring that fixes to the hood.

13. An assembly as described in claim 12 wherein the arrangement includes pivot arms having a first end and a second end that are connected at their first end to the mounting ring and at their second end to the riding surface.

14. An assembly as described in claim 13 wherein the riding surface includes a series of seal segments with each seal segment of the series of seal segments connected to the second end of an associated pivot arm of the pivot arms.

15. A rotary seal assembly for a rotary kiln having a hood and a rotary drum with an opening formed between the drum and the hood, and an end comprising:

a flexible framework arrangement that attaches to the hood, the arrangement includes a mounting ring that fixes to the hood;

a riding surface that engages the drum as the drum rotates and connects with the framework arrangement in response to the movement of the drum as the drum rotates, the arrangement includes pivot arms having a first end and a second end that are connected at their first end to the mounting ring and at their second end to the riding surface, the riding surface includes a series of seal segments with each seal segment of the series of seal segments connected to the second end of an associated pivot arm of the pivot arms; and a seal that is supported by the riding surface and is in essentially 360 degree contact with the drum when it is rotating and seals the opening between the drum and the hood when the drum is rotating in the hood to prevent fluid flow into and out of the end, the seal includes a fabric seal in contact with the mounting ring and the series of seal segments about the drum, the mounting ring includes studs disposed about the drum with the first end of a pivot arm sliding onto a respective associated stud of the studs, the seal includes a tensioning assembly which holds the fabric seal under tension against the series of seal segments, and the fabric seal and the series of seal segments under tension against the drum, the fabric seal includes belt loops and the tension ring assembly includes a tension strap which is laced through the belt loops, metal adjustment buckles attached to the ends of the strap, and metal tension springs attached to the buckles.

16. A method for placing a rotary seal assembly for a rotary kiln having a hood and a rotary drum with an opening formed between the drum and the hood, and an end comprising the steps of:

attaching a flexible framework arrangement to the hood, the arrangement includes a mounting ring that fixes to the hood;

engaging a riding surface with the drum so as the drum rotates, the riding surface connects with the framework arrangement in response to the movement of the drum as the drum rotates, the arrangement includes pivot arms having a first end and a second end that are connected at their first end to the mounting ring and at their second end to the riding surface; and a seal that is supported by the riding surface and is in essentially 360 degree contact with the drum when it is rotating and seals the opening between the drum when it is rotating in the hood to prevent fluid flow into and out of the end, the riding surface includes a series of seal segments with each seal segment of the series of seal segments connected to the second end of an associated pivot arm of the pivot arms.

* * * * *